US005644860A

United States Patent [19]

Piper et al.

[11] Patent Number: 5,644,860

[45] Date of Patent: Jul. 8, 1997

[54] ILLUMINATED SIGNAGE

[76] Inventors: Timothy M. Piper; Christine M. Busnardo, both of 27 Silver Glade Dr., Suite H, Laguna Niguel, Calif. 92677

[21] Appl. No.: 696,795

[22] Filed: Aug. 14, 1996

Related U.S. Application Data

[63] Continuation-in-part of Ser. No. 579,741, Dec. 28, 1995, which is a continuation-in-part of Ser. No. 532,087, Sep. 22, 1995.

[51] Int. Cl.[6] ..... A63H 3/04

[52] U.S. Cl. ..... 40/579; 40/547; 248/222.11

[58] Field of Search ..... 40/547, 579; 362/26, 362/32, 812; 446/485; 248/222.11, 220.31

[56] References Cited

U.S. PATENT DOCUMENTS

| | | | |
|---|---|---|---|
| 1,845,530 | 2/1932 | Tarallo | 40/547 |
| 2,149,363 | 3/1939 | Rivkin | 40/552 |
| 2,173,371 | 9/1939 | Penoyer . | |
| 3,530,615 | 9/1970 | Meyer . | |
| 3,568,357 | 3/1971 | Lebensfeld | 40/547 |
| 3,589,056 | 6/1971 | Glass et al. . | |
| 3,694,945 | 10/1972 | Detiker . | |
| 3,780,695 | 12/1973 | Richard . | |
| 3,949,504 | 4/1976 | Willis et al. . | |
| 4,196,539 | 4/1980 | Speers | 40/547 X |
| 4,216,599 | 8/1980 | Eckert . | |
| 4,276,705 | 7/1981 | Bath et al. | 40/547 X |
| 4,541,812 | 9/1985 | Katsumata . | |
| 4,830,899 | 5/1989 | Nakahashi et al. . | |
| 4,891,030 | 1/1990 | Gertzfeld . | |
| 5,003,233 | 3/1991 | Proud et al. . | |
| 5,190,367 | 3/1993 | Aoki . | |
| 5,324,224 | 6/1994 | Anderson et al. | 40/579 X |

FOREIGN PATENT DOCUMENTS

| | | |
|---|---|---|
| 734659 | 5/1966 | Canada . |
| 1538008 | of 1968 | France . |
| 2843172 | 2/1978 | Germany . |

*Primary Examiner*—Kenneth J. Dorner
*Assistant Examiner*—Cassandra Davis
*Attorney, Agent, or Firm*—Stetina Brunda & Buyan

[57] ABSTRACT

An illuminated sign comprising a housing which defines an opening and includes a light source disposed therewithin. Attached to the housing and covering the opening is a display assembly. The display assembly comprises a perforated outer plate which defines front and back surfaces and includes a plurality of apertures disposed therein. Secured to the back surface of the outer plate is a flexible, opaque diaphragm including a plurality of slits disposed therein which are aligned with respective ones of the apertures of the outer plate. A second flexible opaque diaphragm is also provided which includes slits formed therein in off-set alignment with the slits of the first diaphragm. The display assembly further includes a plurality of light-transmitting pegs, each of which are extensible through respective ones of the apertures and slits which are aligned with each other. The slits are sized and configured to frictionally retain the pegs within the display assembly when the pegs are extended therethrough, and to block the passage of light from the light source through the apertures of the outer plate when the pegs are removed or not extended therethrough.

9 Claims, 7 Drawing Sheets

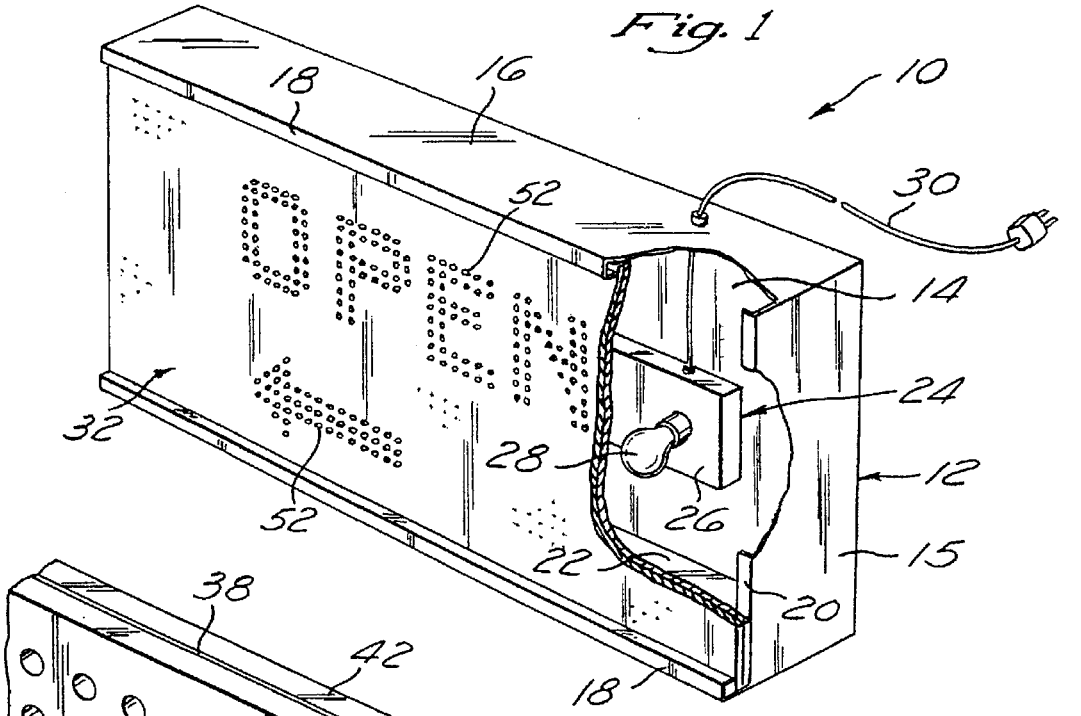
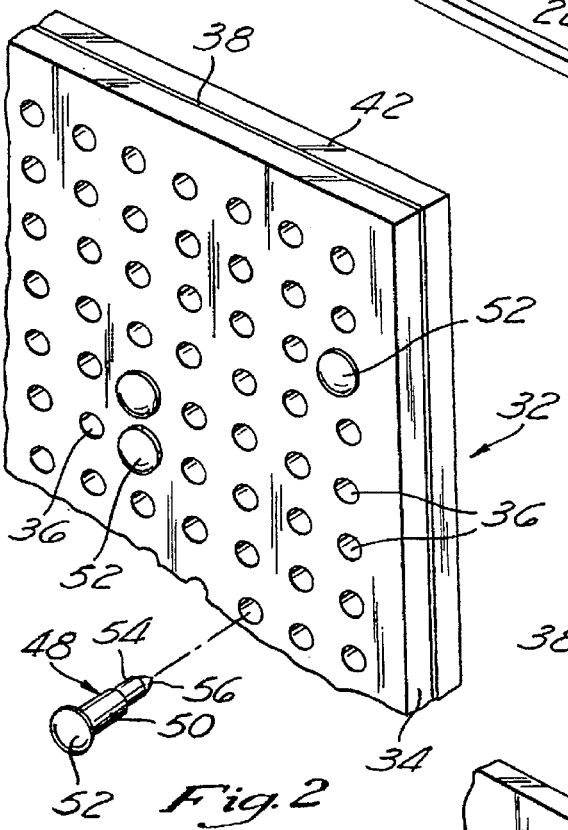
Fig. 2
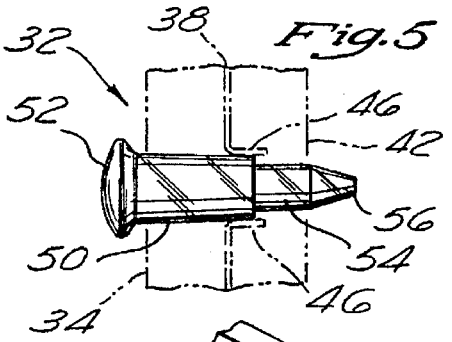
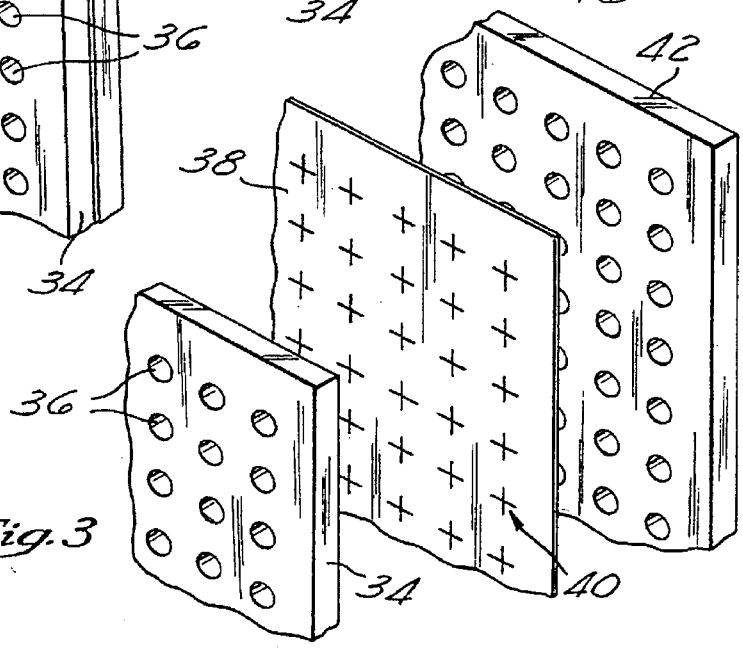
Fig. 3

Fig. 11
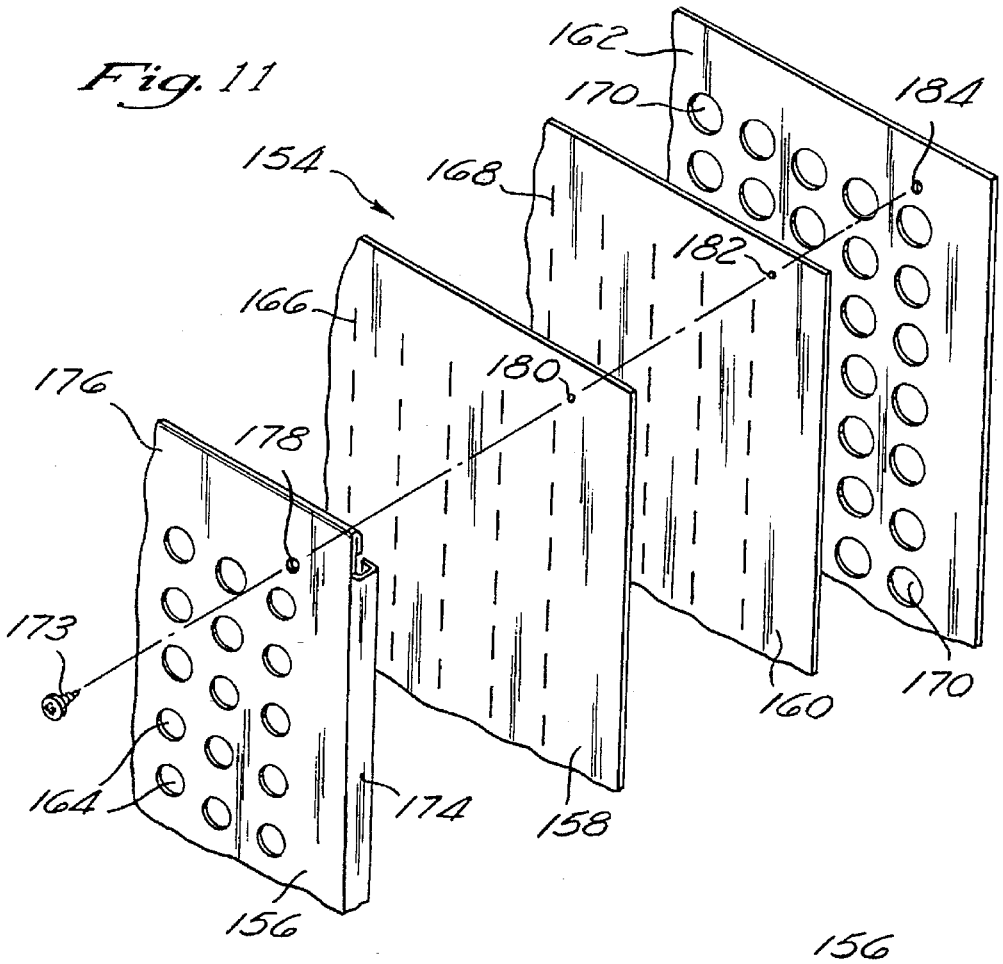
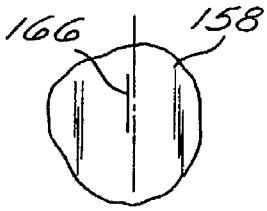
Fig. 12a
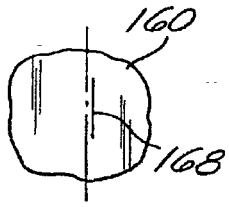
Fig. 12b
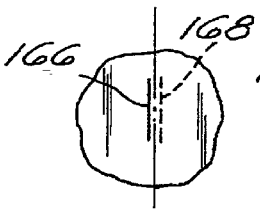
Fig. 12c
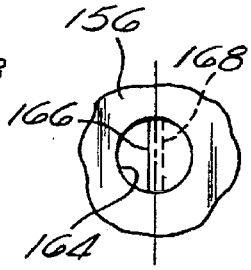
Fig. 12d

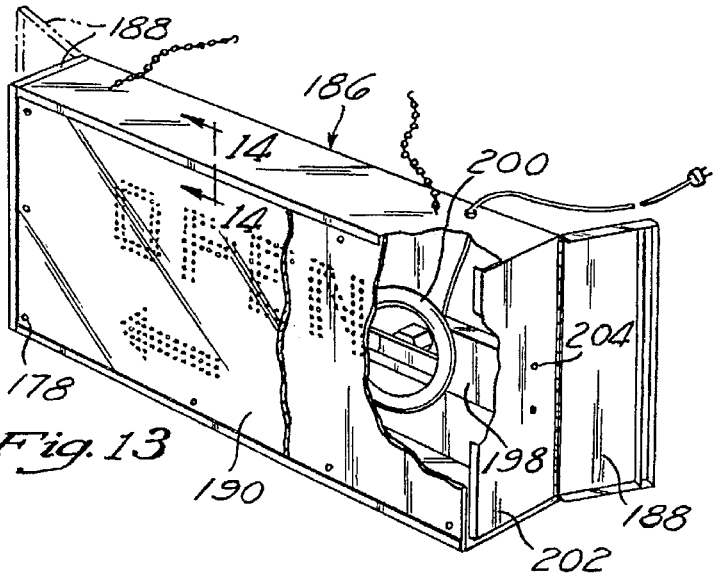
Fig. 13
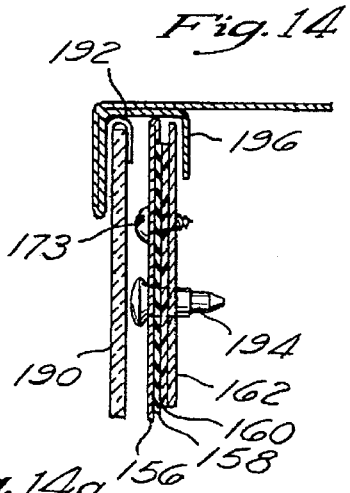
Fig. 14
Fig. 14a
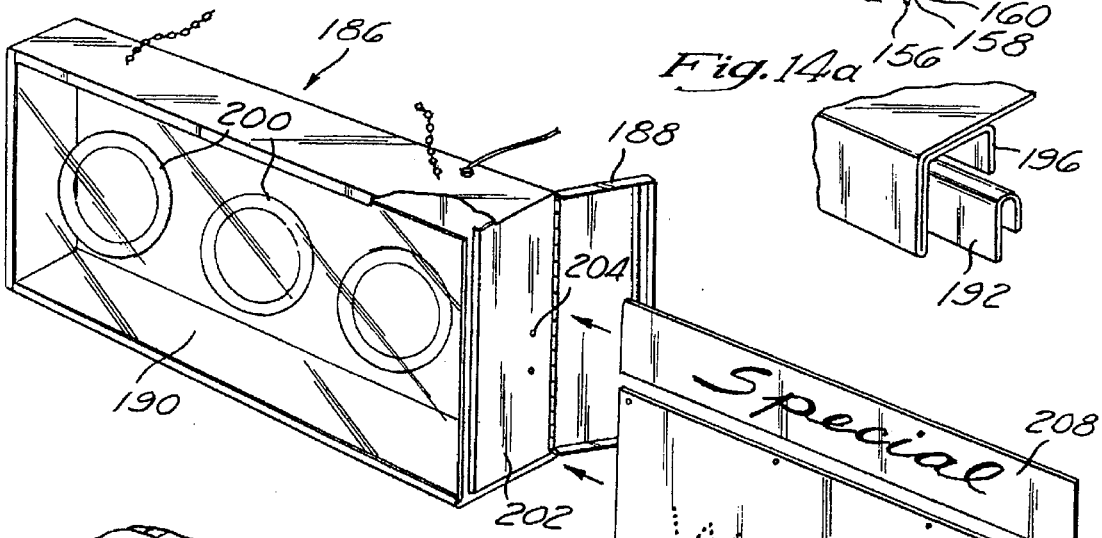
Fig. 15
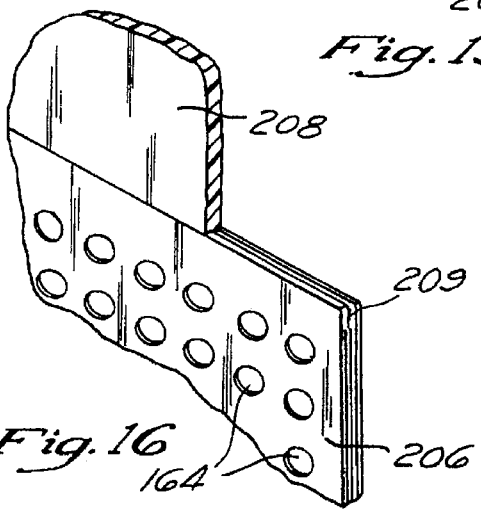
Fig. 16

ILLUMINATED SIGNAGE

RELATED APPLICATIONS

This patent application is a continuation-in-part of U.S. patent application No. 08/579,741 filed on Dec. 28, 1995 entitled ILLUMINATED SIGNAGE which is a continuation-in-part of U.S. Ser. No. 08/532,087 filed on Sep. 22, 1995 and entitled ILLUMINATED SIGNAGE, the contents of which are hereby incorporated by reference.

FIELD OF THE INVENTION

The present invention relates generally to signage, and more particularly to an illuminated sign wherein the message or display provided thereby may be selectively changed in a short period of time with a minimal amount of difficulty.

BACKGROUND OF THE INVENTION

Illuminated signs are well known in the prior art. One of the most common forms of illuminated signage are neon signs which are frequently used in bars, restaurants, and retail stores. Though these neon signs present an eye-catching message or display due to their use of brightly illuminated colors, the message or display provided by such signs cannot be altered in any manner. In this respect, neon signs are formed by one or more elongate glass tubes which are permanently shaped into a desired pattern.

There is also known in the prior art illuminated signs wherein the message or display provided thereby may be modified as desired. However, these prior art signs are typically constructed in a manner wherein the illuminated message or display does not have the visual, eye-catching appeal of the more brightly colored and illuminated neon signs. Additionally, the process of changing the message or display in these prior art signs is often difficult and time consuming.

The present invention addresses the need in the prior art for an illuminated sign which presents a distinct, eye-catching message or display that may be easily and quickly changed or modified as desired.

It is known to produce luminous signs that include a first perforated plate and a second perforated plate having between a piece of cloth or fabric inserted there between and a plurality of coincident cuts in such cloth or fabric which are used to receive a glass or crystal bar. The entire structure is provided over a box that has an internal light source. Such a device is described in Tarallo, U.S. Pat. No. 1,845,530 entitled LUMINOUS SIGN issued Feb. 16, 1932. Although the use of the Tarallo device as described in U.S. Pat. No. 1,845,530 is suitable for frictionally retaining the glass or crystal bar, such device lacks efficiency in blocking the transmission of light from the box once the crystal or glass bar is removed. Accordingly, with the Tarallo device it would be necessary to change the cloth between the plates each time the sign is modified.

Later devices such as those described in Richard, U.S. Pat. No. 3,780,695 entitled WORK SCHEDULING APPARATUS and Rivkin, U.S. Pat. No. 2,149,363 entitled ADVERTISING AND EDUCATIONAL DEVICE include a singular piece of material of rubber material in place of the cloth as described in Tarallo above. A singular piece of material with a plurality of cross-shaped slits, all have a functional purpose of a blockage of light from the apertures that do not currently hold a luminescent peg and frictional retention of the peg once it is inserted. The problems encountered with such devices relate to the removal of the peg to modify the sign and the deformation of cross-slits thus leaving an opening where the slit and the material once met. Even the most minimal separation of the slit material will leak pinholes of light. The natural process of separation is further aggravated by the forced separation of the material by the light transmitting peg. This undesirable separation is particularly prevalent when only one sheet of material is used between the perforated plates.

The leakage of light, although less prevalent, is nevertheless difficulty associated even with a two diaphragm structure. Accordingly, in situations where a first and second diaphragm are inserted between a first perforated plate and the second perforated plate and perpendicular slits in the first diaphragm coincide with and intersect a second slit located in the second diaphragm light leakage can occur. Because the slits intersect, the blockage of light is reliant upon the slit material meeting together at the point of crossing or intersecting. When the slit material fails to meet together tightly, the crossing or intersecting point of the slits of the first and second diaphragms will leek light.

Accordingly, there is a great need in the art for a changeable sign utilizing luminous pegs that once the pegs are removed, there is no leakage of light through the diaphragm (s). The blockage of light is important to the overall appearance of the signage as white light emanating through the unused apertures, distracts from the physical appearance of the signage.

SUMMARY OF THE INVENTION

In accordance with a first embodiment of the present invention, there is provided an illuminated sign comprising a housing which defines an opening and includes a light source disposed therewithin. Attached to the housing is a display assembly which covers the opening. The display assembly itself comprises a perforated outer plate which defines front and back surfaces, and includes a plurality of apertures disposed therein. Secured to the back surface of the outer plate is a flexible, opaque diaphragm. The diaphragm, which is preferably fabricated from rubber, includes a plurality of slits which are die-cut therein and are aligned with respective ones of the apertures of the outer plate. In addition to the outer plate and diaphragm, the display assembly comprises a plurality of light transmitting pegs, each of which are extensible through respective ones of the apertures and slits which are aligned with each other. In the illuminated sign, the slits are sized and configured to frictionally retain the pegs within the display assembly when the pegs are extended therethrough, and to block the passage of light from the light source through the apertures of the outer plate when the pegs are not extended therethrough. When the pegs are removed to alter or change the design or message, the diaphragm constricts, thus blocking any passage of light making it possible to change the configuration of light transmitting pegs as often as desired.

The display assembly attached to the housing may further comprise a perforated inner plate which is secured to the diaphragm in a manner wherein the diaphragm is captured between the inner and outer plates. The inner plate itself includes a plurality of apertures disposed therein which are aligned with respective ones of the apertures of the outer plate and slits of the diaphragm. In this respect, each of the pegs is extensible through respective ones of the apertures of the outer and inner plates and slits of the diaphragm which are aligned with each other.

The pegs included with the display assembly each preferably comprise a cylindrically shaped shank portion defining first and second ends. Formed on the first end of the shank portion is an enlarged head portion, while extending axially from the second end of the shank portion is a reduced diameter piercing portion. Each of the pegs is sized and configured such that when fully inserted into the display assembly, the head portion is abutted against the front surface of the outer plate, the shank portion resides within respective ones of the apertures of the outer and inner plates and slits of the diaphragm which are aligned with each other, and the piercing portion protrudes from the inner plate.

The slits included in the diaphragm each have a generally cross-shaped configuration and include first and second segments which bisect each other, thus forming four triangularly shaped flap portions within the diaphragm. When a peg is extended through apertures of the outer and inner plates and an intervening slit of the diaphragm which are aligned with each other, the flap portions of the slit are forced into the aperture of the inner plate, and are frictionally captured between the shank portion of the peg and the sidewall of the inner plate aperture.

In the first embodiment, the outer plate is preferably fabricated from an opaque material which may be provided in any one of a variety of different colors, but will typically be provided in a black color. Additionally, the pegs which are inserted into the display assembly are provided in a multitude of colors, with the corresponding aperture and slit patterns within the outer and inner plates and diaphragm allowing the pegs to be arranged in any one of a wide variety of different patterns. Since the piercing portions of the pegs protrude beyond the inner plate, light is transmitted from the light source to the head portions of the pegs via the piercing portions and shank portions thereof, thus providing a brightly illuminated and colorful, eye-catching display on a dark background. The housing may further be provided with a generally planar display surface adjacent the display assembly for providing a back-lit sign face message or display which corresponds to that provided by the head portions of the pegs arranged within the display assembly.

In accordance with a second embodiment of the present invention, there is provided an illuminated sign which is substantially similar to that described in relation to the first embodiment, but wherein the diaphragm is fabricated from a transparent rather than an opaque material. Additionally, rather than being fabricated from an opaque material, the outer plate of the display assembly is fabricated from an illuminable, semi-transparent material which may be provided in any one of a variety of different colors. The inner plate provided with the display assembly of the second embodiment is preferably fabricated from a transparent material, thus allowing light to be transmitted from the light source to the outer plate. The display assembly of the sign constructed in accordance with the second embodiment may further include an overlay which is applied to the front surface of the outer plate, the pegs being extensible through the overlay and respective ones of the apertures of the inner and outer plates and slits which are aligned with each other.

In accordance with a third embodiment of the present invention, there is provided an illuminated sign which is substantially similar to that described in relation to the first embodiment, but wherein the diaphragm comprises first and second flexible, opaque diaphragm sheets which are secured in laminar juxtaposition to each other. The first and second diaphragm sheets each include a plurality of linearly extending slits disposed therein which are aligned with each other and respective ones of the apertures of the outer plate. The slits are arranged in the first and second diaphragm sheets in a manner wherein each pair of aligned slits bisect each other in a cross-shaped pattern. The slits of each aligned pair are adapted to frictionally retain the pegs within the display assembly when the pegs are extended therethrough, and block the passage of light from the light source through the apertures of the outer plate when the pegs are not extended therethrough.

In accordance with the fourth embodiment of the present invention there is provided an illuminated sign which is substantially similar to that described in relation to the third embodiment, but where the second opaque diaphragm sheet in laminar juxtaposition to first flexible opaque diaphragm sheet includes a plurality of slits disposed therein which are also aligned with the respective ones of the apertures of the outer plate but are formed in off-set alignment or a mirror image within the diameter of the apertures of the outer plate with the slits of the first opaque diaphragm sheets so that the slits of the second diaphragm sheet do not intersect the slits of the first diaphragm sheet. The slits are staggered to avoid leakage of light even if the slits fail to close completely after the deformation caused by the insertion of a light transmitting peg. The apertures which are located on the inner plate and in alignment with the apertures of the front plate are of a slightly greater diameter than the apertures of the front plate to allow room for expansion of the flexible diaphragms around the light transmitting pegs and to aid in the frictional retention of the pegs within the display assembly when the pegs are extended therethrough.

BRIEF DESCRIPTION OF THE DRAWINGS

These, as well as other features of the present invention, will become more apparent upon reference to the drawings wherein:

FIG. 1 is a front perspective view of an illuminated sign constructed in accordance with a first embodiment of the present invention;

FIG. 2 is a partial perspective view of the display assembly included with the sign shown in FIG. 1;

FIG. 3 is a partial exploded view illustrating the outer and inner perforated plates and diaphragm of the display assembly shown in FIG. 2;

FIG. 5 is a side elevational view of a light transmitting peg as extended through the outer and inner perforated plates and diaphragm of the display assembly;

FIG. 11 is a partial exploded view illustrating the inner and outer perforated plates and first and second diaphragm sheets including the off-set or staggered vertical slits of the display assembly of the fourth embodiment;

FIG. 12*a* is a section partial, cut-away view showing a vertical slit in the first diaphragm sheet in accordance with the fourth embodiment of the present invention;

FIG. 12*b* is a partial, cut-away view showing the vertical slit in the second diaphragm off-set from a vertical axis in accordance with the fourth embodiment of the present invention;

FIG. 12*c* is a partial, cut-away view of vertical slit as shown in FIG. 12*a* but which additionally includes the vertical slit of FIG. 12*b* shown in phantom with each slit being off-set relative to a vertical axis in accordance with the fourth embodiment of the present invention;

FIG. 12*d* is a partial, cut-away view showing the substance of FIG. 12*c* but additionally including the front perforated plate and a single aperture therein about a vertical axis in accordance with the fourth embodiment of the present invention;

FIG. 13 is a front perspective view of a modified illuminated sign constructed in accordance with the present invention wherein the housing cabinet includes side openings for easy modification of the display assembly;

FIG. 14 is a side cross-sectional view of the display signage including the front plexiglass and display assembly interfacing with the cabinet housing;

FIG. 14*a* is a cut-away perspective view of the plexiglass retainer track being inserted onto the upper lip of the housing cabinet;

FIG. 15 is a front perspective view of the modified illuminated sign showing the two-piece display assembly exploded out of the cabinet housing; and FIG. 16 is a cut-away side perspective view showing the interface of the two piece display assembly.

DETAILED DESCRIPTION OF THE PREFERRED EMBODIMENTS

Figure 3A:
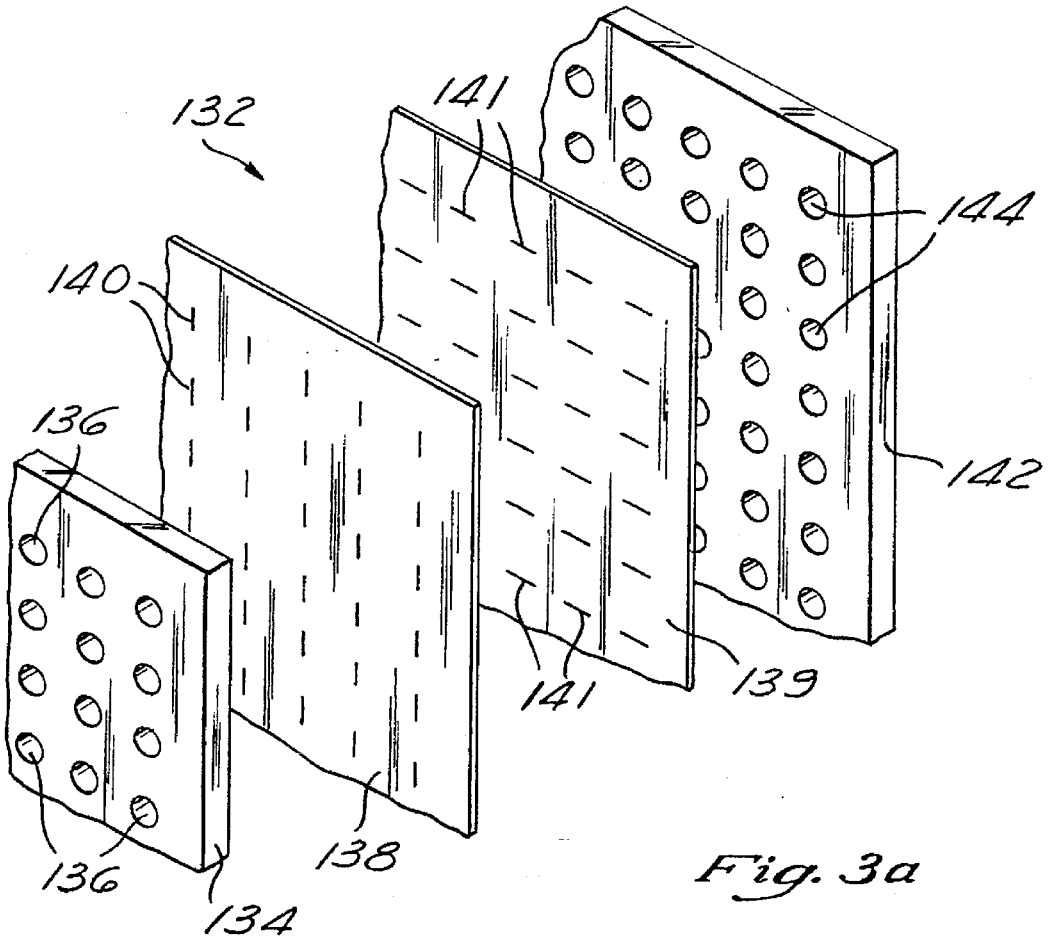
FIG. 3*a* is a partial exploded view illustrating the outer and inner perforated plates and first and second diaphragm sheets of a display assembly which may be used as an alternative to that shown in FIG. 3.

Referring now to the drawings wherein the showings are for purposes of illustrating preferred embodiments of the present invention only, and not for purposes of limiting the same, FIG. 1 perspectively illustrates an illuminated sign 10 constructed in accordance with a first embodiment of the present invention. In the first embodiment, the sign 10 comprises a rectangularly configured housing 12 which includes a generally planar back wall 14 and four (4) laterally extending sidewalls 15 and longitudinally extending sidewalls 16. The longitudinally extending sidewalls 16 each have a height exceeding that of the laterally extending sidewalls 16, and include a generally L-shaped flange portion 18 formed along the outer edge thereof. The laterally extending sidewalls 16 each include a flange portion 20 extending perpendicularly inward from the outer edge thereof. The outer edges of the sidewalls 16, and in particular the flange portions 18, 20 extending therealong, cumulatively define an opening 22 of the housing 12.

Disposed within the housing 12 is a light source 24. The light source 24 comprises an elongate light fixture 26 which is attached to the back wall 14 of the housing 12. Threadably received into sockets extending from the light fixture 26 are a plurality of light bulbs 28. Electrical current is provided to the light bulbs 28 by an electrical cord 30 which extends from the light fixture 26 and through one of the longitudinally extending sidewalls 16 of the housing 12. It will be recognized that alternative light sources, such as fluorescent tubes, may be substituted for the light bulbs 28 previously described. One contemplated alternative may include a light wheel device.

Referring now to FIGS. 2–5, the sign 10 constructed in accordance with the first embodiment further comprises a rectangularly configured display assembly 32 which is attached to the housing 12 and is sized to completely cover the opening 22 defined thereby. In the first embodiment, the display assembly 32 itself comprises a perforated outer plate 34 which includes a plurality of circularly configured apertures 36 disposed therein. As best seen in FIGS. 2 and 3, the apertures 36 are arranged in horizontally and vertically aligned rows, and are equidistantly spaced from each other. Secured to the back surface of the outer plate 34 is a flexible diaphragm 38 which includes a plurality of slits 40 disposed therein. The outer plate 34 and diaphragm 38 are of identical length and width, with the slits 40 being arranged within the diaphragm 38 so as to be aligned with respective ones of the apertures 36 when the diaphragm 38 is secured to the back surface of the outer plate 34. In addition to the apertures 36 and slits 40 being aligned, the peripheral edges of the outer plate 34 and diaphragm 38 are substantially flush when the diaphragm is secured to the back surface of the outer plate 34.

In addition to the outer plate 34 and diaphragm 38, the display assembly 32 includes a perforated inner plate 42 which is identically configured to the outer plate 34 and includes a plurality of circularly configured apertures 44 disposed therein. The apertures 44 of the inner plate 42 and apertures 36 of the outer plate 34 are arranged in identical patterns. The front surface of the inner plate 42 is secured to the diaphragm 38 such that the apertures 44 are aligned with respective ones of the slits 40 and apertures 36. Thus, in the display assembly 32, the diaphragm 38 is sandwiched between the outer and inner plates 34, 42. Additionally, the length and width dimensions of the inner plate 42 are the same as those of the outer plate 34 and diaphragm 38, with the peripheral edge of the inner plate 42 being substantially flush with the peripheral edges of the outer plate 34 and diaphragm 38.

Figure 4:
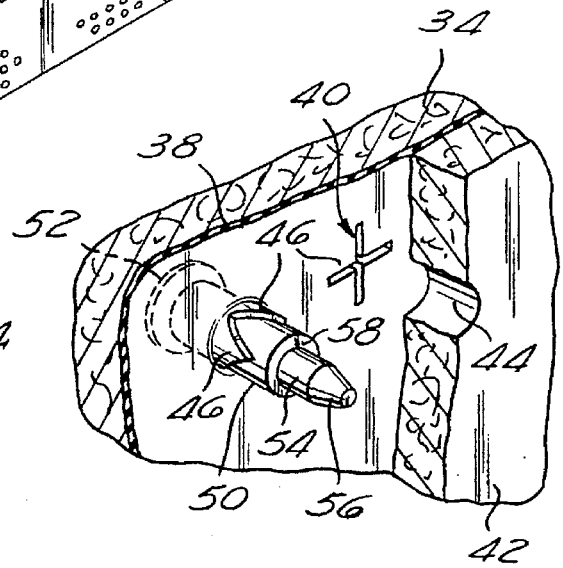
FIG. 4 is a partial, cut-away perspective view illustrating the manner in which portions of the diaphragm of the display assembly are displaced when a light-transmitting peg is extended therethrough.

As best seen in FIGS. 3 and 4, the slits 40 formed in the diaphragm 38 of the display assembly 32 each have a generally cross-shaped configuration and include first and second segments of equal length which perpendicularly bisect each other. In this respect, each of the slits 40 form four (4) triangularly shaped flap portions 46 of equal size within the diaphragm 38. The diaphragm 38 is preferably fabricated from a sheet of rubber, with the slits 40 being die-cut therein. Additionally, the sheet of rubber used to fabricate the diaphragm is preferably opaque for reasons which will be discussed in more detail below. As can be appreciated, the slits 40 may also be formed with a single slit cut within the diaphragm 38 to effect securing the light transmitting pegs and blocking light from the apertures when no peg is in place. The configuration of the slit may be dependent upon the gauge of the rubber of the diaphragm.

The display assembly 32 of the sign 10 further comprises a plurality of light transmitting pegs 48, each of which comprises a generally cylindrical shank portion 50 having an enlarged, generally dome-shaped head portion 52 formed on one end thereof. Extending axially from the opposite end of the shank portion 50 is a cylindrically configured piercing portion 54 which defines a distal, generally frusto-conical piercing tip 56. Due to the reduced diameter of the piercing portion 54, an annular shoulder 58 is defined between the piercing portion 54 and shank portion 50. The pegs 48 are each preferably fabricated from a plastic material, and are provided in any one of a wide range of colors for reasons which will also be discussed below. The head portion 52 may vary in shape, size, and configuration to create different effects.

As best seen in FIGS. 4 and 5, each peg 48 is inserted into the display assembly 32 by extending the shank and piercing portions 50, 54 thereof through respective ones of the apertures 36, 44 and an intervening slit 40 which are aligned with each other. As previously indicted, each aperture 36 of the outer plate 34 is coaxially aligned with a respective one of the apertures 44 of the inner plate 42. Additionally, a respective one of the slits 40 is positioned between each pair of coaxially aligned apertures 36, 44 such that the common axis extends through the point at which the first and second segments of the slit 40 perpendicularly bisect each other. As such, each slit 40 is centrally positioned between a respective pair of coaxially aligned apertures 36, 44. As will be recognized, the passage of the piercing and shank portions 54, 50 of each peg 48 through a respective slit 40 is aided by the inclusion of the piercing tip 56 on the piercing portion 54 which facilitates the initial separation of the flap portions 46.

The shank, head and piercing portions 50, 52, 54 of each peg 48 are preferably sized such that when the peg 48 is fully inserted into the display assembly 32, the head portion 52 is abutted against the front surface of the outer plate 34, with the shank portion 50 residing within a respective pair of the coaxially aligned apertures 36, 44 and intervening slit 40. In some instances, the head portion 52 may not fully abut the front surface of outer plate 34 to create raised or contoured effect. Additionally, the piercing portion 54 resides within the aperture 44, with the piercing tip 56 thereof protruding from the back surface of the inner plate 42. Importantly, the shank portion 50 is sized having a diameter which is slightly less than the diameters of the apertures 36, 44. In this respect, when a peg 48 is extended through a pair of coaxially aligned apertures 36, 44 and the intervening slit 40, the flap portions 46 of the slit 40 are forced into the aperture 44 during the passage of the piercing and shank portions 54, 50 therethrough, and are frictionally captured between the shank portion 50 and the sidewall of the aperture 44 when the peg 48 is fully inserted into the display assembly 32 (i.e., the head portion 52 is abutted against the front surface of the outer plate 34). Conversely, when the peg 48 is removed from within the coaxially aligned apertures 36, 44 and intervening slit 40, the flap portions 46 of the slit 40 resiliently return to their unflexed condition, as shown in FIG. 3.

Advantageously, the capture of the flap portions 46 between the shank portion 50 and sidewall of the aperture 44 facilitates the frictional retention of the peg 48 within the display assembly 32. Indeed, the flap portions 46 are caused to be wedged between the shank portion 50 and sidewall of the aperture 44, thus necessitating that a significant pulling force be applied to the peg 48 to remove the same from within the display assembly 32, and more particularly the aperture 44. It will be recognized that due to the fabrication of the diaphragm from rubber and the resultant resiliency of the flap portions 46, the peg 48 would be frictionally maintained within the display assembly 32 by the contact of the flap portions 46 against the shank portion 50 thereof, even if the flap portions 46 were not compressed between the shank portion 50 and sidewall of the aperture 44.

As will be recognized, the pegs 48 may be inserted into the display assembly 32 in any desired pattern, so as to form words, pictures, or combinations thereof. Additionally, the message or display of the sign 10 may be provided in a single color or multiple colors, depending on peg selection. Due to the manner in which the pegs 48 are inserted into and removed from within the display assembly 32, the message or display provided by the sign 10 may be quickly and easily changed as desired.

As seen in FIG. 1, the display assembly 32 is attached to the housing 12 by sliding the same underneath the flange portions 18 such that the ends of the flange portions 18 are abutted against the front surface of the outer plate 34, and the flange portions 20 are abutted against the back surface of the inner plate 42. As such, the display assembly 32 is captured between the flange portions 18, 20. Since the piercing tip 56 of each peg 48 protrudes beyond the back surface of the inner plate 42, the activation of the light source 24 causes light to be efficiently transmitted to the head portion 52 of the peg 48 via the piercing tip 56, piercing portion 54 and shank portion 50 thereof.

In the illuminated sign 10, the outer plate 34 is fabricated from an opaque material, and preferably a material that is black in color, though the same may be provided in any one of a variety of different colors. As previously indicated, the sheet of rubber used to fabricate the diaphragm 38 is also fabricated from an opaque material, and preferably one that is also black in color. As also previously explained, the flap portions 46 of each slit 40 facilitate the frictional retention of a peg 48 within the display assembly 32 when extended therethrough. Importantly, due to the resilience of the flap portions 46, when a peg 48 is not extended therethrough, the flap portions 46 are operable to block the passage of light from the light source 24 through the aperture 36 of the outer plate. Thus, when the light source 24 is activated, visible light is transmitted solely from the head portions 52 of the pegs 48 which are set against the black background of the opaque outer plate 34. Since light is prevented from being transmitted through those apertures 36 in which no peg 48 has been inserted by the flap portions 46 of the corresponding slit 40, a solid dark background is maintained for the illuminated head portions 52 of the pegs 48. Though not shown, it will be recognized that clear pegs 48 may be used in the display assembly 32, with different colors being transmittable thereby by inserting a color wheel within the housing 12 between the light bulbs 28 and back surface of the inner plate 42.

Figure 10:
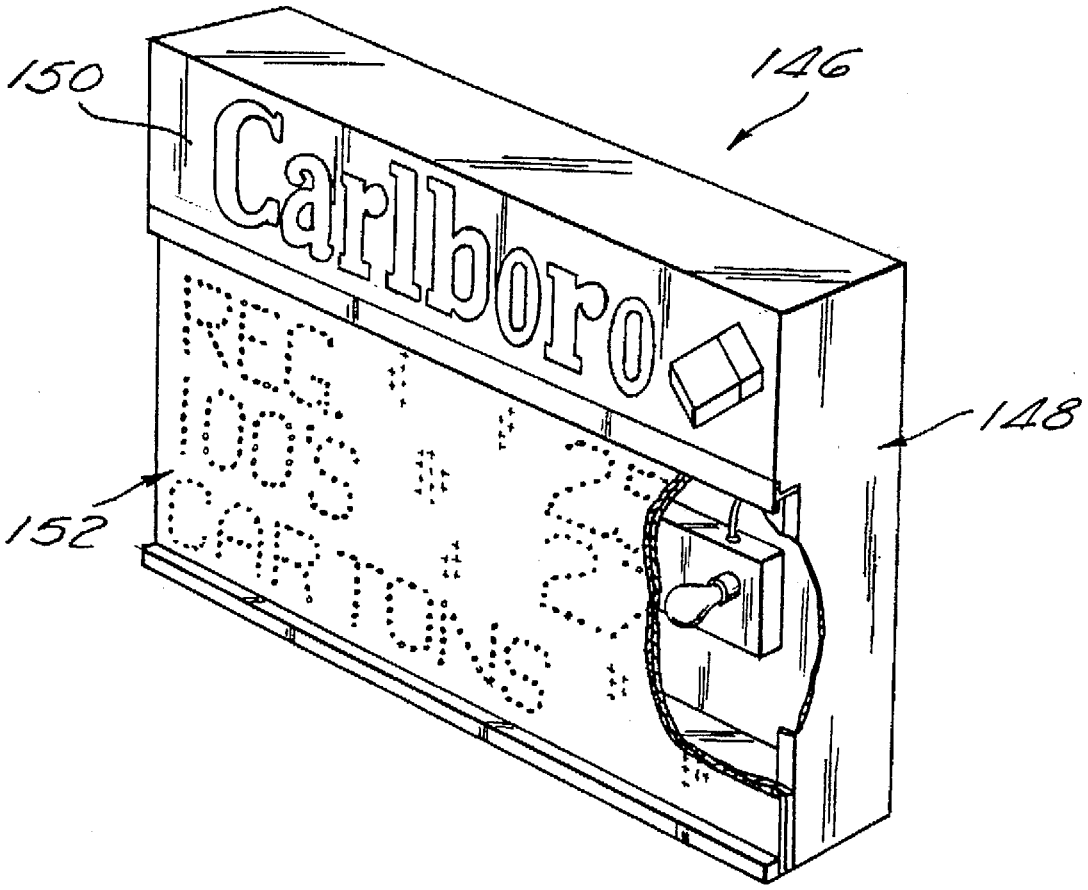
FIG. 10 is a front perspective view of an illuminated sign similar to that shown in FIG. 1, but further including a back-lit sign face message or display adjacent the display assembly.

Though not shown, the housing 12 of the sign 10 constructed in accordance with the first embodiment may be provided in alternative configurations, e.g., circular, triangular, square, etc. In this respect, all that is necessary is that the display assembly 32 be shaped so as to cover any opening defined by the housing. Additionally, as seen in FIG. 10, a sign 146 is shown with the housing 148 formed to include a generally planar display surface 150 adjacent the display assembly 152 so as to provide a back-lit sign face message or display along with the illuminated message or display provided by the display assembly 152. The display surface 150 may also provide a message which is non-illuminated.

Referring now to FIG. 3*a*, there is depicted a display assembly 132 which may be used in the sign 10 as an alternative to the previously described display assembly 32. The display assembly 132 comprises a perforated outer plate 134 which is identically configured to the outer plate 34 and includes a plurality of circularly configured apertures 136 disposed therein. The display assembly 132 also includes a perforated inner plate 142 which is identically configured to the inner plate 42 and includes a plurality of circularly configured apertures 144 disposed therein. Sandwiched between the outer and inner plates 134, 142 in the display assembly 132 is a diaphragm which itself comprises a first flexible, opaque diaphragm sheet 138 which is secured to the back surface of the outer plate 134. Disposed within the first diaphragm sheet 138 are a plurality of linearly extending slits 140. Secured to the first diaphragm sheet 138 is a second flexible, opaque diaphragm sheet 139 which itself includes a plurality of linearly extending slits 141 disposed therein. The inner plate 142 is secured to the exposed surface of the second diaphragm sheet 139.

Importantly, the apertures 136, 144 of the outer and inner plates 134, 142 and slits 140, 141 of the first and second diaphragm sheets 138, 139 are arranged in identical patterns. Thus, when the first and second diaphragm sheets 138, 139 are sandwiched between the outer and inner plates 134, 142, the apertures 136 are aligned with respective ones of the slits 140, 141 and apertures 144. However, the apertures 140, 141 of the first and second diaphragm sheets 138, 139 extend perpendicularly relative to each other, with each pair of the aligned slits 140, 141 bisecting each other in a cross-shaped pattern. Like the diaphragm 38 previously described, the diaphragm sheets 138, 139 are each preferably fabricated from rubber, with the slits 140, 141 being die-cut therein. Alternatively, the slits 140, 141 may be die-cut with alternate shapes such as L-shape or U-shape or such other shape to form a flap-like opening.

Each peg 48 is inserted into the display assembly 132 by extending the shank and piercing portions 50, 54 thereof through respective ones of the apertures 136, 144 and intervening slits 140, 141 which are aligned with each other.

As previously indicated, each aperture 136 of the outer plate 134 is coaxially aligned with the respective one of the apertures 144 of the inner plate 142. Additionally, a respective pair of the slits 140, 141 is positioned between each pair of coaxially aligned apertures 136, 144 such that the common axis extends through the point at which the slits 140, 141 perpendicularly bisect each other. As such, each pair of slits 140, 141 is centrally positioned between a respective pair of coaxially aligned apertures 136, 144. The passage of the piercing and shank portions 54, 50 of each peg 48 through a respective pair of slits 140, 141 is aided by the inclusion of the piercing tip 56 on the piercing portion 54 which facilitates the initial separation of the slits 140, 141.

The shank, head and piercing portions 50, 52, 54 of each peg 48 are preferably sized such that when the peg 48 is fully inserted into the display assembly 132, the head portion 52 is abutted against the front surface of the outer plate 134, with the shank portion 50 residing within a respective pair of the coaxially aligned apertures 136, 144 and intervening slits 140, 141. In some instances, the head portion 52 may not fully abut the front surface of the outer plate 134 so as to create a raised or contoured effect. Additionally, the piercing portion 54 resides within the aperture 144, with the piercing tip 56 thereof protruding from the back surface of the inner plate 142. Since the shank portion is sized to have a diameter which is slightly less than the diameters of the apertures 136, 144, the extension of the peg 48 through a pair of coaxially aligned apertures 136, 144 and the intervening slits 140, 141 forces portions of the first and second diaphragm sheets 138, 139 into the aperture 144 during the passage of the piercing and shank portions 54, 50 therethrough. These portions of the first and second diaphragm sheets 138, 139 are frictionally captured between the shank portion 50 and the side wall of the aperture 144 when the peg 48 is fully inserted into the display assembly 132 (i.e., the head portion 52 is abutted against the front surface of the outer plate 134 or alternatively, the head portion 52 may extend into aperture 136 to be abutted against the diaphragm and flush with the surface of the outer plate 134. In this case, the diameter of the aperture 136 would be greater than the diameter of the head portion 52). Conversely, when the peg 48 is removed from within the coaxially aligned apertures 136; 144 and intervening slits 140, 141, the first and second diaphragm sheets 138, 139 resiliently return to their unflexed condition. As will be recognized, the capture of portions of the first and second diaphragm sheets 138, 139 between the shank portion 50 and side wall of the aperture 144 facilitates the frictional retention of the peg 48 within the display assembly 132.

Figure 7:
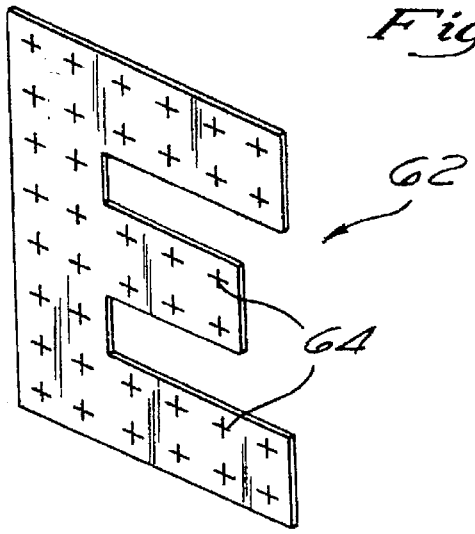
FIG. 7 is a perspective view of an overlay which may be included with the display assembly shown in FIG. 6.
Figure 6:
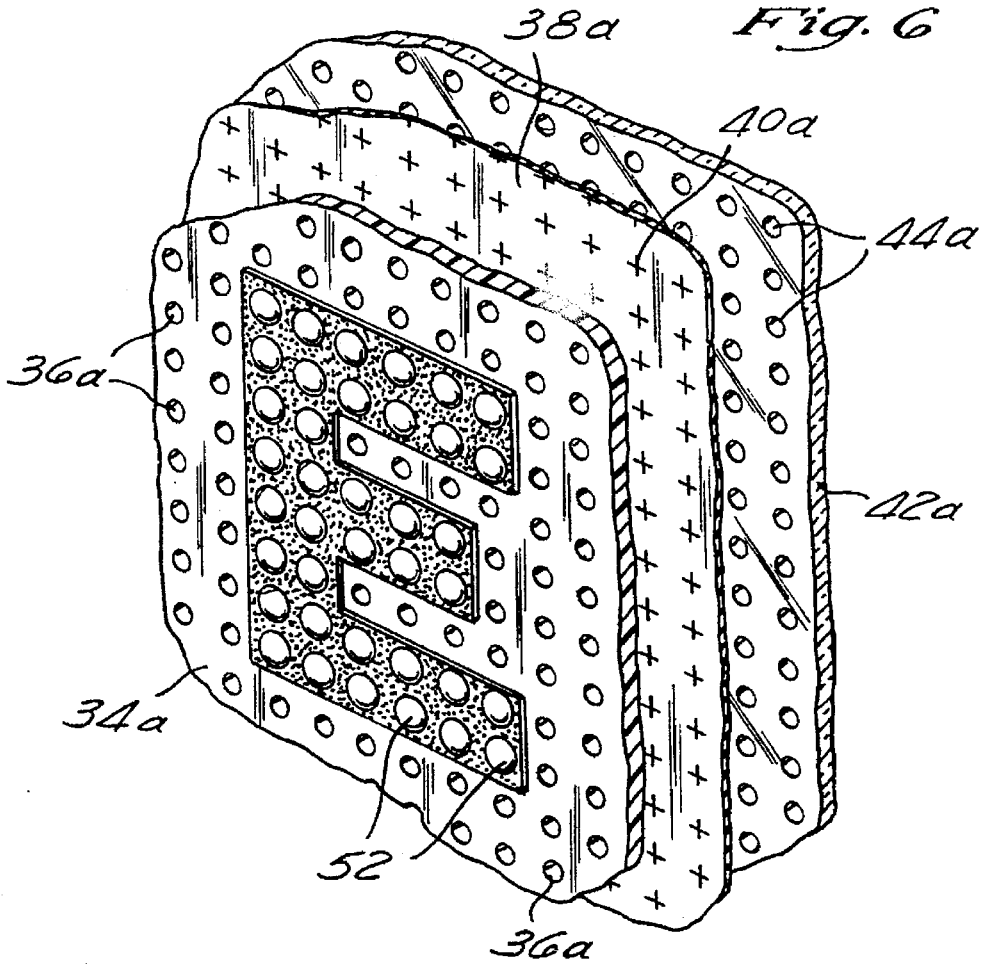
FIG. 6 is a partial exploded view of the display assembly of an illuminated sign constructed in accordance with a second embodiment of the present invention.

Referring now to FIGS. 6 and 7, in accordance with a second embodiment of the present invention, the sign 10 may include a display assembly **32*a* which is identical to the previously described display assembly 32, except that the outer plate 34*a* thereof is fabricated from a semi-transparent material, with the diaphragm 38*a* and inner plate 42*a* each being fabricated from a clear or transparent material. As will be recognized, in this particular embodiment the activation of the light source 24 will not only illuminate the head portions 52 of the pegs 48 inserted into the display assembly 32*a*, but will also cause the underlying front surface of the outer plate 34*a* to be illuminated due to the transmission of light through the clear/transparent inner plate 34*a* and diaphragm 38*a***.

The illumination of the semi-transparent outer plate **34*a* provides a glowing background for the head portions 52 of the pegs 48. However, the brightness or intensity of the outer plate 34*a* is preferably more subtle than the head portions 52, thus providing a visually apparent contrast. The outer plate 34*a* may be provided in any one of a variety of different colors. It will be recognized that since the diaphragm 38*a* is transparent, white light will be visible through those apertures 36*a* of the outer plate 34*a* in which no peg 48 is inserted. However, this effect may be mitigated by fabricating the diaphragm 38*a* from a semi-transparent material having a color matching that of the outer plate 34*a*. Though a semi-transparent material would not transmit light as efficiently as a clear or transparent material, sufficient light would still pass through the diaphragm 38*a* fabricated from a semi-transparent material so as to illuminate the outer plate 34*a***.

As further seen in FIGS. 6 and 7, the display assembly **32*a* constructed in accordance with the second embodiment may further include an overlay 62 which is fabricated from a thin sheet of flexible material such as rubber or vinyl. The overlay 62 includes a plurality of slits 64 disposed therein which are configured identically to the slits 40*a* of the diaphragm 38*a* (as well as the slits 40 of the diaphragm 38). The overlay 62 is applied to the front surface of the outer plate 34*a* in a manner wherein the slits 64 thereof are aligned with respective ones of the apertures 36*a* (and hence respective ones of the slits 40*a* of the diaphragm 38*a* and apertures 44*a* of the inner plate 42*a*). Subsequent to the application of the overlay 62 to the front surface of the outer plate 34*a*, pegs 48 are extensible through respective ones of the slits 64, 40*a* and apertures 36*a*, 44*a* which are aligned with each other. As will be recognized, when the pegs 48 are extended therethrough and fully inserted into the display assembly 32*a*, the overlay 62 is captured between the head portions 52 of the pegs 48 and the front surface of the outer plate 34*a*, thus maintaining the overlay 62** firmly thereagainst.

In the second embodiment, the overlay 62 may be provided in any shape, with the "E" depicted in FIGS. 6 and 7 being solely for exemplary purposes. The inclusion of the overlay 62 within the display assembly **32*a* provides additional visual contrast between the brightly illuminated head portions 52 of the pegs 48, and the more subtly illuminated outer plate 34***a*. The overlay 62 may also be provided in any one of a variety of different colors. Although cross-slits 64 are shown, the actual configuration of the perforations will be determined by the material utilized, i.e., slits or holes. If overlay 62 is made of a rigid material, a trim-cap may be affixed to the perimeter thereof.

Figure 8:
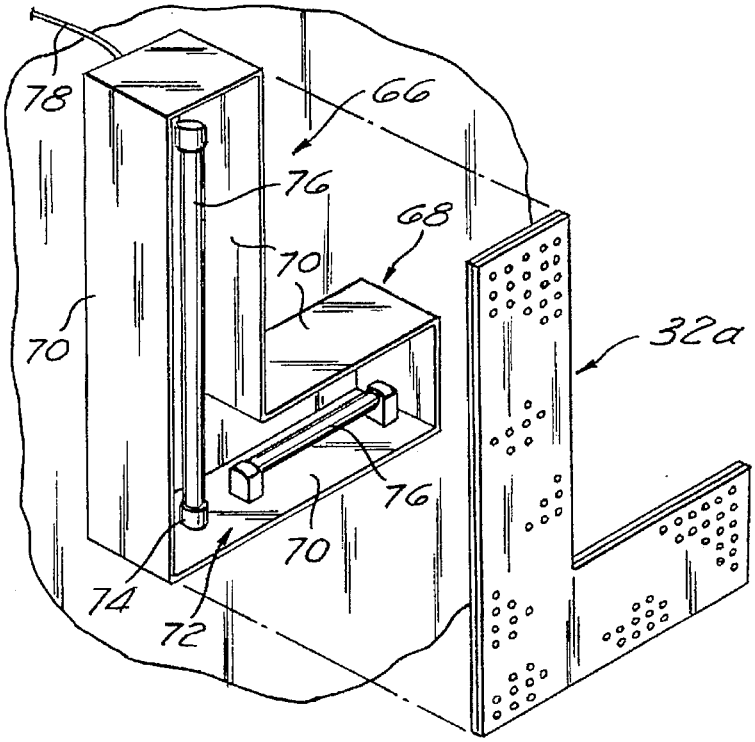
FIG. 8 is an exploded view of an illuminated letter including the display assembly constructed in accordance with the second embodiment.
Figure 9:
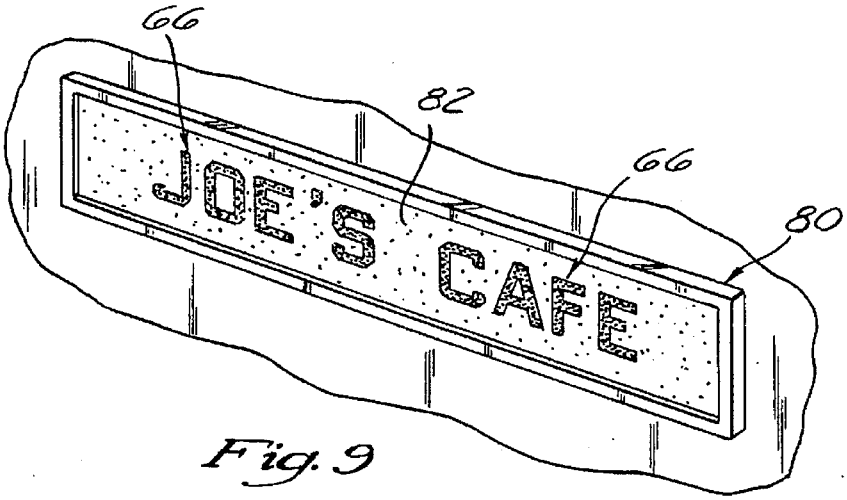
FIG. 9 is a perspective view illustrating an exemplary manner in which multiple illuminated letters including the display assembly constructed in accordance with the second embodiment may be combined to form a sign.

Referring now to FIGS. 8 and 9, rather than being used in the illuminated sign 10, the display assembly 32*a* constructed in accordance with the second embodiment (excluding the overlay 62) may be used as a component of an illuminated letter 66. The illuminated letter 66 comprises a housing 68 having the shape of a particular letter. The housing 68 itself comprises a plurality of sidewalls 70, the outer edges of which define an opening 72. Disposed within the housing 68 is a light source 74 which preferably comprises fluorescent tubes 76, the power for which is provided by an electrical cord 78 extending from the housing 68. The display assembly 32*a* used in the illuminated letter 66 is shaped to conform to and completely cover the opening 72 when attached to the housing 68.

Typically, when the display assembly 32*a* is used in the illuminated letter 66, each set of aligned apertures and slits 36*a*, 40*a*, 44*a* will include a peg 48 inserted thereinto. As such, the illuminated letter 66 will display the brightly illuminated head portions 52 of the pegs 48 which are contrasted by a more subtly illuminated background. It will be recognized that the illuminated letter 66 may constitute any letter of the alphabet, with the letter "L" shown in FIG. 8 being for exemplary purposes only. In this respect, as seen in FIG. 9, a series of illuminated letters 66 may be combined to form an illuminated sign 80, with the letters 66 preferably being suitably contrasted by an appropriately colored background 82 of the sign 80. The display assembly 32*a* may be appropriately trim-caped as is functionally and aesthetically necessary.

Referring now to FIGS. 11, 12*a*, 12*b*, 12*c* and 12*d*, there is shown the display assembly 154 of the fourth embodiment of the present invention. The display assembly 154 comprises an outer perforated plate 156, a first flexible diaphragm 158, a second flexible diaphragm 160 and an inner perforated plate 162. In the preferred embodiment the first flexible diaphragm 158 and second flexible diaphragm 160 are opaque.

The rectangularly configured display assembly 154 is designed to be attached to a housing which includes an inner light source and is sized to completely cover the opening of the housing defined thereby. A housing would be similar to that shown in FIG. 1. The perforated outer plate 156 includes a plurality of circularly configured apertures 164 disposed therein. The apertures 164 are arranged in horizontal and vertical aligned rows and are equally distantly spaced from each other. Secured to the back surface of the outer perforated plate 156 is a first flexible diaphragm 158 which includes a plurality of slits 156 disposed therein. The outer perforated plate 156 and the first flexible diaphragm 158 are of identical length and width with the slits 166 being arranged within the first flexible diaphragm 158 so as to be aligned with the respective ones of the apertures 164 when the first flexible diaphragm 158 is secured to the back surface of the outer perforated plate 156.

In addition to the apertures 164 and the slits 166 being aligned, the peripheral edges of the outer perforated plate 156 and the first flexible diaphragm 158 are substantially flush when the first flexible diaphragm 158 is secured to the back surface of the outer perforated plate 156. The alignment of the slits 166 with the apertures 164 are provided in slight off-set alignment relative to a vertical axis which of the circular aperture 164. The off-set nature of the location of the slit 166 relative to the circular aperture 164 is best shown in FIG. 12*d*. For purposes of this Application the term off-set means that the slits, although being aligned with the aperture and positioned that the slits do not intersect.

Secured to the first flexible diaphragm sheet 158 is a second flexible opaque diaphragm sheet 160 which includes a plurality of vertically extending slits 168 disposed therein. The inner perforated plate 162 is thereafter secured to the exposed surface of the second flexible diaphragm sheet 160. The inner perforated plate 162 also includes a plurality of circularly configured apertures 170 disposed in the inner perforated plate 162. Importantly, the apertures 164 of the outer perforated plate 156 and the apertures 170 of the inner perforated plate 162 are arranged in identical patterns. The diameter of the circular apertures 170 of the inner perforated plate 162 is slightly greater than the diameter of the apertures 164 of the outer perforated plate 156.

The second diaphragm 162 additionally includes a plurality of slits 168 disposed therein. The slits 168 are arranged in the diaphragm 160 so as to be aligned with respective ones of the apertures 164 of the outer perforated plate 156 (and coincidentally with the apertures 170 of the inner perforated plate 162) when the diaphragm 160 is secured to the back of the first flexible diaphragm 158. The pattern of the vertical slits within the second flexible diaphragm 160 is an identical mirror image pattern of the slits 166 of the first flexible diaphragm 158. Accordingly, when the identical rectangular pieces are placed together with the mirror image slit arrangement, the slits 168 are in off-set alignment with the slits 166 of the first flexible diaphragm 158. The off-set alignment of the slits 166 and 168 within the aperture 164 is best shown in FIG. 12*d*.

Importantly, the apertures 164 of the outer perforated plate 156 is in off-set alignment with the slits 166 of the first flexible diaphragm 158 and further off-set alignment with the slits 168 of the second flexible diaphragm 160 in which is in alignment with the aperture 170 of the inner perforated plate 162. Thus, when the first flexible diaphragm sheet 158 and the second flexible diaphragm sheet 160 are sandwiched between the outer perforated plate 156 and the inner perforated plate 162 the apertures 164 are aligned with respective ones of the off-set slits 166 and 168 and apertures 170. The slits 166 and 168 although shown in parallel alignment may be modified to be in any angle of direction so long as such slits are accessible within the apertures 164 and 170 and so long as the slits 166 and 168 do not bisect each other.

The diaphragm sheets 158 and 160 each preferably include the slits 166 and 168 which are di-cut therein. Alternatively, the slits 166 and 168 may be di-cut with alternate shapes such as L-shapes or U-shapes or other shapes to form a flap-like opening, but in each instance the slits of the first inner flexible diaphragm sheet 158 would not intersect the slits of the second flexible diaphragm sheet 160. The preferable material used for the first flexible diaphragm 158 and the second flexible diaphragm 160 is a heat resistant, flexible material with the necessary memory to return to its original shape such as neoprene but not limited to the same. The function of the first flexible diaphragm 158 and the second flexible diaphragm 160 is to create an overlapping of materials so that even if the slit 166 or 168 fails to completely close then the overlapping of the material over the slit 166 or 168 will prevent light leakage.

Because the slits 168 of the second flexible diaphragm 160 are di-cut in an off-center pattern which is a mirror image to that of the slits 166 of the first flexible diaphragm 158, during production of the flexible diaphragms, the diaphragms can be di-cut with identical patterns, and the second flexible diaphragm 160 is merely reversed in a mirror image to create the overlap effect. This aids in the manufacturing process of the flexible diaphragms. Because the flexible diaphragms are high in elasticity, prepping the flexible material is crucial to the production process of precision di-cutting the diaphragms 158 and 160. The flexible material must be relaxed and completely free of any previous stretching incurred during manufacturing of the flexible material to prevent shrinkage after the diaphragms are di-cut. The mirror imaging of the diaphragms is dependent upon precision accuracy in di-cutting the slits 166, 168 and the adjoining holes 180, 182 in creating the overlap of slits 166, 168.

A flange 174 runs the length of the bottom of the outer perforated plate 156 and on each side of the outer perforated plates 56 and terminates slightly before the top edge 176 of the outer perforated plate 156. In addition the diaphragms 158 and 160 also terminates slightly before the top edge 176, providing a channel 209 the width of the diaphragms 158 and 160. The elimination of the flange 174 from the top edge and the tops of the side edges, and providing a channel is for purposes of including a secondary light panel which is shown and described in greater detail in relation to FIGS. 15 and 16.

Accordingly, the light transmitting peg such as the one shown in FIG. 5 may be inserted through the aperture 164 piercing the first off-set slit 166, the slightly off-set second aperture 168 and the aperture 170. The flexible nature of the diaphragms 156 and 158 allow for sufficient deformation to allow passage of a light transmitting peg through the slits 166 and 168 even though those slits are slightly off-set. Accordingly, the subsequent removal of the light transmitting peg from the aperture 164, the flexible nature of the diaphragms 158 and 160 allow for the closure of those apertures due to the neoprene's shape memory. Because the slits 166 and 168 are off-set, the blockage of light is not reliant upon each of the slits 166 and 168 coming completely closed. The slits may remain slightly open but the overlap of the material because the slits are off-set completely block any light leakage. Although not shown, a lubricant such as a graphite powder or charcoal powder may be introduced to both the front and rear surfaces of the first flexible diaphragm 58 and the second flexible diaphragm 160 to ease the passage of a light transmitting peg through the entire display assembly structure and allows the slits 166 and 168 of the diaphragms 158 and 160 to move freely and return closed in an overlap position without sticking or catching when the light transmitting pegs are removed. In addition, the slightly larger diameter of the aperture 170 of the inner perforated plate allows the material which is pushed inwardly by a light transmitting peg to bulge in the aperture 170 area and to also aid in the passage of light transmitting peg through the display assembly 154 structure and to aid in the frictional retention of said peg. Also shown in FIG. 11 is a mounting screw 173 which interfaces with the hole 178 of the outer perforated plate, the hole 180 of the first flexible diaphragm 168, the hole 182 of the second flexible diaphragm 160 and the hole 184 of the inner perforated plate 162. The hole 178 and the corresponding holes of the remaining layers of the display assembly 154 are provided so that the display assembly 154 may be one complete unit which may be removed or inserted into a light cabinet. Like holes appear throughout the surface of elements 156, 158, 160 and 162 for purposes of securing display assembly.

Referring particularly to FIG. 13, there is shown a modified cabinet housing 186. The modified cabinet 186 includes hinged doors 188 which may be opened on either side of the cabinet 186 to allow the insertion or removal of a display assembly such as that shown in display assembly 154. Referring also to FIGS. 14 and 14*a* a piece of plexiglass 190 is interfaced with the housing via a track which is inserted into the upper and lower portions of the front of the housing to hold the plexiglass 190 in place. The plexiglass 190 is desirable as it prevents unwanted removal of light transmitting pegs such as the peg shown as 194 and to protect the head portion of the light transmitting pegs from obstruction, such as dust or other elements. Also, a flange 196 is additionally provided to provide an inner track for insertion and removal of a display assembly into and out of the housing cabinet 186.

A horizontal mounting bracket 198 is provided to allow the inclusion of multiple lights 200 to serve as the back illumination for a display assembly. The bracket 198 is secured to the inner side walls 202 via mounting screws 204. The bracket 198 extending to the side walls 202 also acts as a stabilizing brace for the cabinet 186.

Referring particularly to FIG. 15 there is shown a display assembly 206 which comprises each of the components as shown in FIG. 11 and wherein a second semi-opaque rectangularly shaped signage piece 208 wherein a track is formed by the termination of the flange 174 and the plastic signage piece 208 may be slid into that track to engage the display assembly 206 and may be inserted into the cabinet 186. The signage piece 208 may be formed by any of number of semi-opaque material which allows the back lighting of that plastic material for purposes of illumination.

It is additionally contemplated by the present invention, particularly with respect to the first, second and third embodiments that to further prevent light leakage of either the cross-slit configuration or the dual-diaphragm bisecting slit configuration that additional opaque pegs may be inserted into any aperture which is not occupied by a light transmitting peg. Thus the use of the additional opaque pegs may alleviate the problem associated with light leakage. Additionally, the opaque pegs may provide a desirous aesthetic contrasting effect.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A changeable reusable illuminated sign, comprising:

a housing defining an opening;

a light source disposed within said housing;

a display assembly attached to said housing and covering said opening, said display assembly comprising:

a perforated outer plate defining front and back surfaces and including a plurality of apertures disposed therein;

a first flexible, opaque diaphragm sheet secured to the back surface of the outer plate and including a plurality of slits disposed therein which are aligned with respective ones of the apertures of the outer plate;

a second flexible, opaque diaphragm sheet in laminar juxtaposition to said first diaphragm sheet, said second diaphragm sheet including a plurality of slits disposed therein which are aligned with respective ones of the apertures of the outer plate and off-set relative to the slits of the first diaphragm sheet; and a plurality of light-transmitting pegs, each of said pegs being extensible through respective ones of the apertures and pairs of the off-set slits of the first and second diaphragm sheets;

said off-set slits of the first and second diaphragm sheets being sized and configured to frictionally retain the pegs within the display assembly when the pegs are extended therethrough, and to provide overlapping material to block the passage of light from the light source through the apertures of the outer plate when the pegs are not extended therethrough.

2. The sign of claim 1 wherein said display assembly further comprises:

a perforated inner plate secured to the second diaphragm sheet in a manner wherein the first and second diaphragm sheets are captured between the outer and inner plates, said inner plate including a plurality of apertures disposed therein which are aligned with respective ones of the apertures of the outer plate and respective pairs of said slits of the first and second diaphragm sheets;

each of said pegs being extensible through respective ones of the aligned apertures of the outer and inner plates and respective pairs of said slits of the first and second diaphragm sheets disposed therebetween.

3. The sign of claim 2 wherein each of the pegs comprises:

a shank portion defining first and second ends; and an enlarged head portion formed on the first end of the shank portion;

each of said pegs being sized and configured such that when fully inserted into the display assembly, the head portion is abutted against the front surface of the outer plate, the shank portion resides within respective ones of the aligned apertures of the outer and inner plates and respective pairs of said slits of the first and second diaphragm sheets disposed therebetween, and the second end of the shank portion protrudes from the inner plate.

4. The sign of claim 2 wherein the plurality of apertures of the inner plate which are in alignment with respective ones of the apertures of the outer plate each have a diameter greater than the diameter of the apertures of the outer plate.

5. The sign of claim 2 wherein the outer plate is fabricated from an opaque material.

6. The sign of claim 1 wherein the first and second diaphragm sheets are fabricated from flexible material with said slits being die-cut therein.

7. The sign of claim 1 wherein said first diaphragm sheet and said second diaphragm sheet each include a powdered lubricant applied thereto.

8. The sign of claim 7 wherein said powdered lubricant is a graphite powder.

9. The sign of claim 7 wherein said powdered lubricant is a charcoal powder.

* * * * *